United States Patent [19]

Skinner

[11] Patent Number: 4,601,430

[45] Date of Patent: Jul. 22, 1986

[54] ASH GRINDER FOR SCRUBBER SYSTEM

[75] Inventor: Michael F. Skinner, Blaine, Minn.

[73] Assignee: Northern States Power Company, Minneapolis, Minn.

[21] Appl. No.: 608,779

[22] Filed: May 10, 1984

[51] Int. Cl.[4] ..... B02C 18/08

[52] U.S. Cl. ..... 241/101.2; 241/243; 261/DIG. 9

[58] Field of Search ..... 241/189 A, 190, 101.2, 241/243

[56] References Cited

U.S. PATENT DOCUMENTS

| | | | |
|---|---|---|---|
| 246,992 | 9/1881 | Anderson . | |
| 345,408 | 7/1886 | Birge . | |
| 361,000 | 4/1887 | Creager . | |
| 369,434 | 9/1887 | Chisholm . | |
| 637,664 | 11/1899 | Porter | 241/190 |
| 664,852 | 1/1901 | Green . | |
| 889,555 | 6/1908 | Stedman | 241/190 X |
| 3,154,622 | 10/1964 | Reinfeld et al. . | |
| 3,428,263 | 2/1969 | Sackett, Sr. | 241/190 X |
| 3,556,421 | 1/1971 | Galanty | 241/86 |
| 3,957,211 | 5/1976 | Nakamura et al. | 241/73 |
| 3,976,252 | 8/1976 | PerDue | 241/46.02 |

*Primary Examiner*—Mark Rosenbaum

*Attorney, Agent, or Firm*—Merchant, Gould, Smith, Edell, Welter & Schmidt

[57] ABSTRACT

An ash grinder (30) which is particularly adapted for reducing chunks of fly ash from a flue gas scrubber system to facilitate further handling, includes a rectangular throat section (32) of uniform cross-section with a shaft (52) extending therethrough. The shaft (52) is supported by bearings (54) on pedestals (56) located external to the throat section (32). Sets of perpendicular blades (66, 68) are secured to shaft (52) for rotation between opposite sets of fixed blades (48) located inside the throat section (32). The shaft (52) is driven by a reversible motor (76) through a chain and sprocket arrangement (70, 72 and 74) at a relatively slow speed on a continuous basis so that any large chunks of fly ash formed within the scrubber chamber, such as during a system upset for example, will be reduced to an acceptably smaller size to facilitate further handling without manual intervention or interruption of system operation.

4 Claims, 5 Drawing Figures

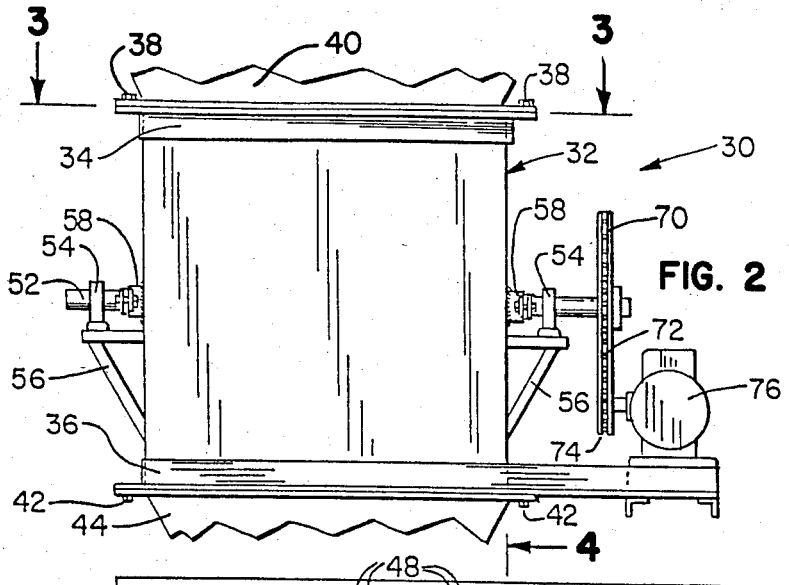
FIG. 2
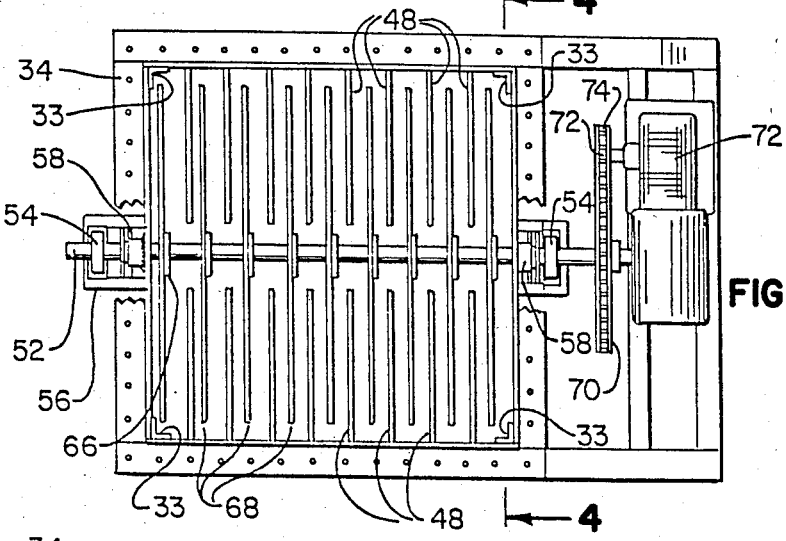
FIG. 3
FIG. 4
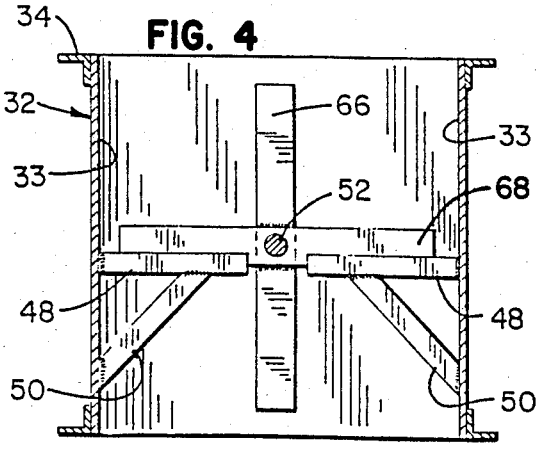
FIG. 5
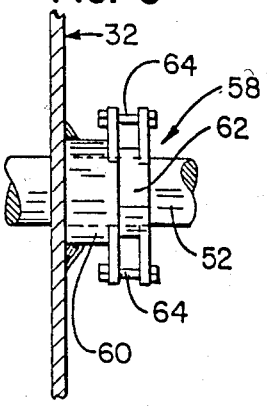

ASH GRINDER FOR SCRUBBER SYSTEM

TECHNICAL FIELD

The present invention relates generally to a comminution device. More particularly, this invention concerns an apparatus which is particularly adapted for use with a flue gas scrubber of a power plant for reducing large chunks of fly ash and dried slurry from the scrubber chamber into pieces small enough for handling by the ash conveyor system.

BACKGROUND OF THE INVENTION

Scrubber systems have been developed for controlling harmful emissions from industrial and utility boilers like those used in power plants. Such scrubber systems generally include a chamber in which the flue gas is directed through a liquid spray of lime and fly ash slurry. A reaction occurs with the sulfur dioxide in the gas to form a calcium compound fly ash which can then be collected at the outlet of the chamber, thereby "scrubbing" the flue gas free of sulfur dioxide pollutants.

When the various parameters of such dry scrubbers are properly balanced, the resultant ash can be easily collected and handled in particulate form; however, if system upsets occur, the liquid lime and fly ash slurry can collect and harden on the walls of the chamber. This material can subsequently fall off in large chunks and sheets which can plug the outlet of the chamber and thus disrupt operation of the entire system. In the past it has been necessary to shut down the system and then disassemble a portion of the outlet of the scrubber chamber in order to break up and remove any large chunks of ash clogging the outlet. It will be appreciated that this ash material is quite hard and cementicious in consistency, and that removal of clogs can be a difficult, time-consuming, and expensive task.

Various comminuting devices have been available heretorfore, however, none of the prior devices is adapted or particularly suited for use with a scrubber chamber for reducing hard and often times relatively large chunks of ash material on a continuous basis to facilitate discharge and further handling without interrupting operation of the overall system. A need has thus developed for such a device.

SUMMARY OF INVENTION

The present invention comprises an ash grinder which overcomes the foregoing and other difficulties associated with the prior art. In accordance with the invention, there is provided a unique ash grinder which is particularly adapted for use with the scrubber chamber of a flue gas scrubber system of the type used with power generating plants. The grinder, which is adapted for mounting at the outlet of the scrubber chamber, includes a throat section of uniform cross-section, preferably square. Flanges are provided at the upper and lower ends of the throat section for attachment to adjacent sections. A shaft extends through the section and is supported for rotation by bearings located outside of this section. Sets of perpendicular blades are secured to the shaft for cooperation with sets of fixed blades secured to opposite sides of the throat sections. As the shaft is driven the rotating blades pass between the fixed blades so that any ash chunks received in the throat section are reduced to a predetermined smaller size, such as two inches in diameter, for example. The shaft and rotating blades are preferably driven by a reversible motor through a chain and sprocket arrangement to provide for clearance without disassembly should an unusually large chunk of ash become jammed therein.

BRIEF DECRIPTION OF DRAWINGS

A better understanding of the invention can be had by reference to the following Detailed Description in conjunction with the accompanying Drawings, wherein:

FIG. 2 is a side elevational view of the ash grinder herein;

FIG. 3 is a horizontal sectional view taken along lines 3—3 of FIG. 2 in the direction of the arrows with certain portions cutaway for clarity;

FIG. 4 is a vertical sectional view taken along lines 4—4 of FIG. 3 in the direction of the arrows; and FIG. 5 is a detail of the shaft mounting of the ash grinder herein.

DETAILED DESCRIPTION

Figure 1:
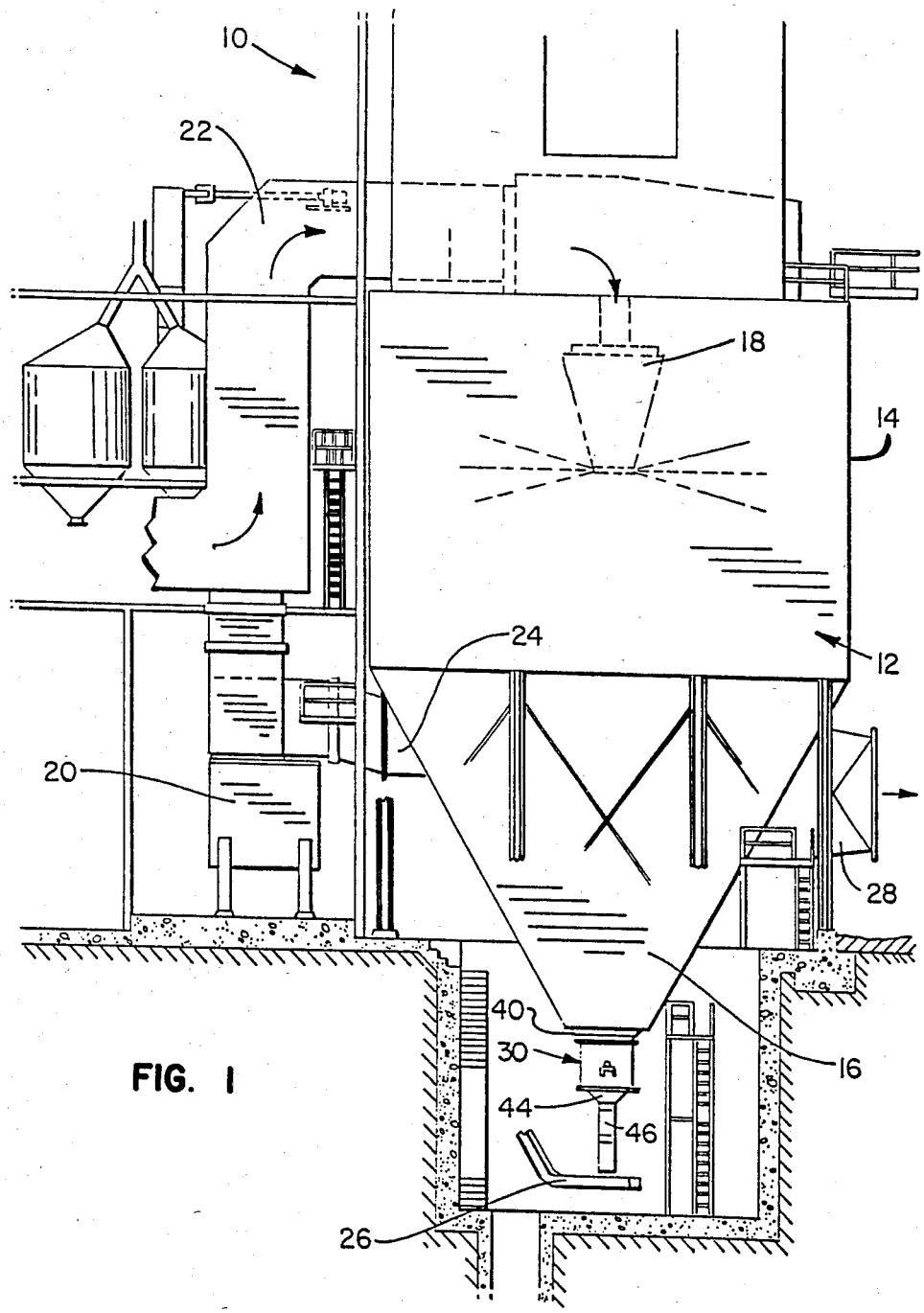
FIG. 1 is a side elevational view of a portion of a flue gas scrubber system including the ash grinder of the invention mounted between the outlet of the scrubber chamber and the ash conveyor.

Referring now to the Drawings, wherein like reference numerals designate like or corresponding elements throughout the views, and particularly referring to FIG. 1, there is shown a portion of a scrubber system 10 for emissions treatment, particularly removal of sulfur dioxide from the flue gas of power generating plants. The system 10 includes a scrubber chamber 12 including an upper generally cylindrical portion 14 and lower generally conical portion 16. A rotary atomizer 18 is located within the upper portion 14 of the scrubber chamber 12. A liquid slurry of lime and fly ash from a feed tank 20 is pumped to the rotary atomizer 18 and sprayed outwardly inside the scrubber chamber 12, into which flue gas is also directed via a top inlet 22 and a bottom inlet 24. Under normal conditions the lime in the slurry reacts with the sulfur dioxide in the flue gas before impacting the inside wall of the chamber 12 to form ashes which normally fall downwardly into the lower portion 16 of the chamber 12 for collection and removal via a conveyor 26. The "scrubbed" flue gas leaves the chamber 12 via an outlet 28. Under certain conditions, such as a system upset for example, the slurry from the rotary atomizer 18 can impact the inside walls of the scrubber chamber 12 thus collecting and hardening into a mass which will later break off in chunks and sheets that can clog the outlet of the chamber.

As will be explained more fully hereinafter, an ash grinder 30 is provided at the outlet of the scrubber chamber 12 for reducing any such chunks or sheets of dried ash into suitably small pieces for handling by the conveyor 26 on a continuous basis without any disassembly or other disruption of the operation of the scrubber system 10. The ash grinder 30 is adapted for operation on a continuous basis for breaking up any large chunks of ash which might be formed in the chamber 12 during a system upset, while permitting the passage of particular ash formed during balanced steady state operation of the scrubber system 10.

The constructional details of the ash grinder 30 of the invention can be seen in FIGS. 2–5. The ash grinder 30 includes a hollow body or throat section 32 of uniform cross-section. As illustrated, the throat section 32 comprises four upright plates arranged in end to end relationship and secured to inside corner channels 33, as is best seen in FIG. 3. The throat section 32 is preferably of square cross-section about 36 inches on a side, for example. Peripheral flanges 34 and 36 are provided about the top and bottom ends of throat section 32, respectively. The upper flange 34 is secured by bolts 38 to a transition section 40 mounted on the outlet of the scrubber chamber 12. The transition section 40 is of the round/square type. The lower flange 36 is secured by bolts 42 to another transition section 44 which is of the square/square-type connected to a conduit 46 discharging over the conveyor 26, as is best seen in FIG. 1. The throat section 32 and flanges 34 and 36 are preferably formed of steel.

A plurality of fixed blades 48 are provided inside the throat section 32. The blades 48 are arranged in predetermined spaced apart relationship in opposing sets or rows on opposite sides of the throat section 32. Each fixed blade 48, for example, can be about 15 inches in length with the blades being postioned on about 4 inch centers. A knee brace 50 is provided for each fixed blade 48 for purposes of reinforcement. The blades 48 and braces 50 are preferably formed of steel plate.

A shaft 52 extends through aligned holes in the other two sides opposing of the throat section 32. The shaft 52 is journalled for rotation between a pair of pillow block bearings 54 mounted on pedestals 56 outside of the throat section 32. The shaft 52 extends through stuffing boxes 58 secured over the shaft access holes in the sides of the throat section 32. Each stuffing box 58 is of substantially conventional construction, including an outer sleeve 60 welded to the outside of the throat section 32 and an inner sleeve extending into the outer sleeve as is best seen in FIG. 5. The sleeves 60 and 62 include flanges which are interconnected by bolts 64 to compress the gasket (not shown) between the sleeves and thereby form a tight seal therebetween.

Sets of blades 66 and 68 are also provided at predetermined spaced intervals on the shaft 52 inside the throat section 32. Each pair of blades 66 and 68 are preferably oriented perpendicularly and are positioned for rotation between the fixed blades 48. For example, the rotating blades 66 and 68 can be formed from steel plate about 32 inches in length and positioned on about 4 inch centers so that the spacing between adjacent fixed and rotating blades during operation of the grinder 30 is about 2 inches. The rotational axis of the shaft 52 is preferably positioned slightly above or below the plane of the upper edges of the fixed blades 48, and/or the depths of the rotating blades 66 and 68 and the fixed blades, so that a more pronounced shearing effect occurs as the rotating blades pass between the fixed blades.

Rotation of the shaft 52 and blades 66 and 68 is effected through a driven sprocket 70 on the shaft which is connected by a chain 72 to a drive sprocket 74 of a motor 76. A protective guard (not shown) is preferably provided around the sprockets 70 and 74 and chains 72 for safety purposes. For example, the motor 76 can be reversible electric motor of about 2 horsepower, like that available from Dresser Industries, geared to drive shaft 52 at a relatively low speed of about 8–15 r.p.m. A low drive speed is preferable because it reduces vibration, the need for careful balancing of the shaft 52 and rotating blades 66 and 68, and the need for thrust bearings to axially constrain the shaft. The motor 76 drives the shaft 52 and rotating blades 66 and 68 on a continuous basis while the scrubber system 10 is operating to reduce any ash chunks into a suitable size such as about 2 inches in diameter or less, for passage to and handling by the conveyor 26. The motor 76 is also equipped with an internal overload relay for signalling stoppage or stalling of the motor, such as in the event of cloggage by an unusually large chunk of ash from the scrubber chamber 12. In the unlikely event of such a cloggage, the motor 76 could thus be reversed to clear it without disassembly or interruption of the system operation.

From the foregoing, it will thus be apparent that the present invention comprises a unique ash grinder which is particularly adapted for reducing large, dried and hard chunks of ash which can sometimes be formed in flue gas scrubber chambers. The grinder herein is of rugged, relatively straightforward construction for ease of maintenance and extended service. Usage of the ash grinder herein avoids expensive down time in the event of system upsets which would otherwise result in large chunks of ash clogging the outlet of the scrubber chamber. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. In combination with the flue gas scrubber system of a power plant having a scrubber chamber with a lower portion converging to an outlet, an ash grinder for mounting in the outlet of the scrubber chamber, comprising:

a vertical, open throat section of rectangular cross-section having upper and lower ends;

mounting flanges secured about the upper and lower ends of said throat section;

a generally horizontal shaft extending through said throat section between said mounting flanges, said shaft having opposite ends positioned outside of said throat section;

a pair of support pedestals, each pedestal being secured to the outside of said throat section beneath an end of said shaft;

a bearing mounted on each support pedestal for rotatably journalling the associated end of said shaft;

a stuffing box connected between each end of said shaft and the associated side of said throat section;

a plurality of substantially perpendicular pairs of straight first blades mounted in substantially uniform spaced-apart relationship on said shaft for rotation within said throat section;

a plurality of opposite pairs of straight second blades mounted in substantially uniform spaced-apart relationship on the inside of said throat section and extending between the pairs of first blades on said shaft, said second blades having upper edges lying generally in a common horizontal plane;

said shaft being rotatable about a generally horizontal axis positioned between the said common horizontal plane and the upper end of said throat section to effect a shearing action between said first and second blades; and brace members for reinforcing said second blades, said brace members being angled toward the lower end of said throat section;

a driven sprocket secured to one end of said shaft;

a drive sprocket;

a chain interconnecting said drive and driven sprockets; and a reversible drive motor coupled to said drive sprocket for effecting rotation of said shaft and said first blades to reduce any large ash chunks falling into said throat section from the scrubber chamber.

2. The ash grinder of claim 1, wherein said throat section is of square cross-section and is comprised of four metal plates secured in end-to-end relationship to a like number of upright corner braces.

3. The ash grinder of claim 1, wherein each stuffing box comprises:

an outer sleeve secured to said throat section;

an inner sleeve extending into said outer sleeve and surrounding said shaft; and means for securing said sleeves together to compress a gasket in sealing engagement about said shaft.

4. The ash grinder of claim 1, further including:

an upper transition section secured between the scrubber chamber and the upper end of said throat section;

a lower transition section secured to the lower end of said throat section; and a conveyor extending beneath said lower transition section.

* * * * *